US005490666A

United States Patent [19]

Albert

[11] Patent Number: 5,490,666

[45] Date of Patent: Feb. 13, 1996

[54] FOLDER WITH SPRING-BIASED EXIT ROLLER

[75] Inventor: Kevin F. Albert, Barrington, N.H.

[73] Assignees: Heidelberger Druchemaschiner AG, Heidelberg, Germany; Heidelberg Harris, Inc., Dover, N.H.

[21] Appl. No.: 297,728

[22] Filed: Aug. 29, 1994

[51] Int. Cl.[6] ..... B41F 13/58; B65H 5/02; B65G 15/14

[52] U.S. Cl. ..... 270/5; 270/41; 271/274; 198/626.4; 493/357; 493/416

[58] Field of Search ..... 270/5, 6, 8, 10, 270/13, 21.1, 32, 41, 42, 43, 47; 493/357, 436, 446, 416; 271/274, 275; 474/101, 109, 131, 85, 94; 198/626.4, 626.6

[56] References Cited

U.S. PATENT DOCUMENTS

| | | | |
|---|---|---|---|
| 655,355 | 8/1900 | Scott | 270/10 X |
| 1,849,958 | 3/1932 | Roesen | 493/357 |
| 1,883,224 | 10/1932 | Wood | 493/357 |
| 3,894,479 | 7/1975 | Anikanov et al. . | |
| 4,470,590 | 9/1984 | Ariga et al. . | |
| 4,496,339 | 1/1985 | Moll | 271/274 X |
| 4,537,390 | 8/1985 | Kiamco et al. . | |
| 4,948,112 | 8/1990 | Sato et al. | 270/47 X |
| 5,057,064 | 10/1991 | Michalik | 493/424 X |
| 5,064,180 | 11/1991 | Wingate . | |
| 5,112,033 | 5/1992 | Breton | 270/47 |
| 5,203,846 | 4/1993 | Kuhns et al. | 271/274 X |
| 5,405,126 | 4/1995 | Mack | 270/43 X |

FOREIGN PATENT DOCUMENTS

| | | | |
|---|---|---|---|
| 371784 | 3/1923 | Germany | 474/109 |
| 2541502 | 3/1977 | Germany | 270/47 |
| 2070733 | 9/1981 | United Kingdom | 474/94 |
| 2168686 | 6/1986 | United Kingdom . | |

*Primary Examiner*—Edward K. Look
*Assistant Examiner*—John E. Ryznic
*Attorney, Agent, or Firm*—Kenyon & Kenyon

[57] ABSTRACT

A folder apparatus is disclosed which has at least one lead-in tape mechanism having a left lead-in tape and left exit roller and a corresponding right lead-in tape and right exit roller, the fight and left lead-in tapes forming a signature passage for delivery of a stream of signatures. One of the exit rollers is spring-loaded in the direction of a fixed exit roller. The spring loading takes place with two springs acting opposite one another, the springs having different spring rates or modula. This dual spring action reduces pounding caused by the signatures as they pass through the lead-in tapes.

11 Claims, 4 Drawing Sheets

Fig. 4

| Spring Rate of First Spring (lbs./in.) | Spring Rate of Second Spring (lbs./in.) |
|---|---|
| 50 - 100 | 500 - 1000 |

FOLDER WITH SPRING-BIASED EXIT ROLLER

FIELD OF THE INVENTION

The invention relates generally to printing presses and more particularly to the lead-in tape mechanism of a folder apparatus for a printing press for delivering signatures.

BACKGROUND OF THE INVENTION

Lead-in tape systems are commonly used to deliver signatures from a printing press to a stack. A lead-in tape system typically comprises a plurality of lead-in tape mechanisms spaced apart from one another and located side-by-side to one another to contact the signature across its width. Each lead in-tape mechanism has a lead-in tape on one side and a corresponding counter-rotating lead-in tape on the other side to form a signature passage, so that the signature is grasped on both sides and may be transported through the signature passage. Often the signature leaves the signature passage and enters a fan which receives the signature in a fan pocket. The signature is then delivered to a stack as the fan or fans rotate, as described in U.S. Pat. No. 5,112,033, herewith incorporated by reference.

The lead-in tapes typically have guide rollers and a drive roller located inside the lead-in tape for guiding and driving the tape. There are guide rollers at the bottom of the lead-in tape where the signature exits, i.e. the exit rollers.

One exit roller is typically fixed and the other exit roller spring-loaded by a single spring in the direction of the fixed roller to maintain a positive squeeze on the signature as it enters the fans. This squeeze is necessary to assist in driving the signatures into the fans to help deliver the signatures. As the signatures pass through the exit rollers, there is a head-to-tail space or gap between the individual signatures to allow the tips of successive fans to pass between the signatures. When the spring-loaded exit rollers encounter this gap in the signature stream, they close on the fixed rollers and reopen when the head of the next signature is encountered. This creates a bounce phenomena which causes high dynamic loads on the fixed rollers.

Premature failure of the bearings, tapes or other components may then occur, as well as fretting corrosion of the loaded components and slippage of exit roller levers which hold the exit roller. Replacement of these parts can be time-consuming and costly.

SUMMARY OF THE INVENTION

An object of the present invention is to reduce the pounding caused by the passage of the signatures through the lead-in tape exit rollers.

Another object of the invention is to reduce the premature failure of bearings, tapes or other components.

The present invention therefore provides a folder apparatus comprising: at least one lead-in tape mechanism having a first lead-in tape and first exit roller and a corresponding second lead-in tape and second exit roller, the first and second lead-in tapes forming a signature passage for delivery of a signature; the first exit roller rotatable about a first roller axis but otherwise fixed; and a lever for supporting the second exit roller, the second exit roller rotatably mounted on the lever about a second roller axis; an arm connected to the lever, the arm having a first side and an opposing second side; a first spring acting against the first side of the arm to urge the lever and second exit roller in the direction of the first exit roller; and a second spring acting against the second side of the arm.

This double spring arrangement allows for reduced pounding as the signatures pass through the lead-in tape mechanism, as well as reducing the chances of premature failure of bearings, tapes and other components.

BRIEF DESCRIPTION OF THE DRAWINGS

The present invention will be described in greater detail with respect to the drawings below:

FIG. 4 is a chart showing illustrative spring rates in accordance with an embodiment of the present invention.

DETAILED DESCRIPTION

Figure 1:
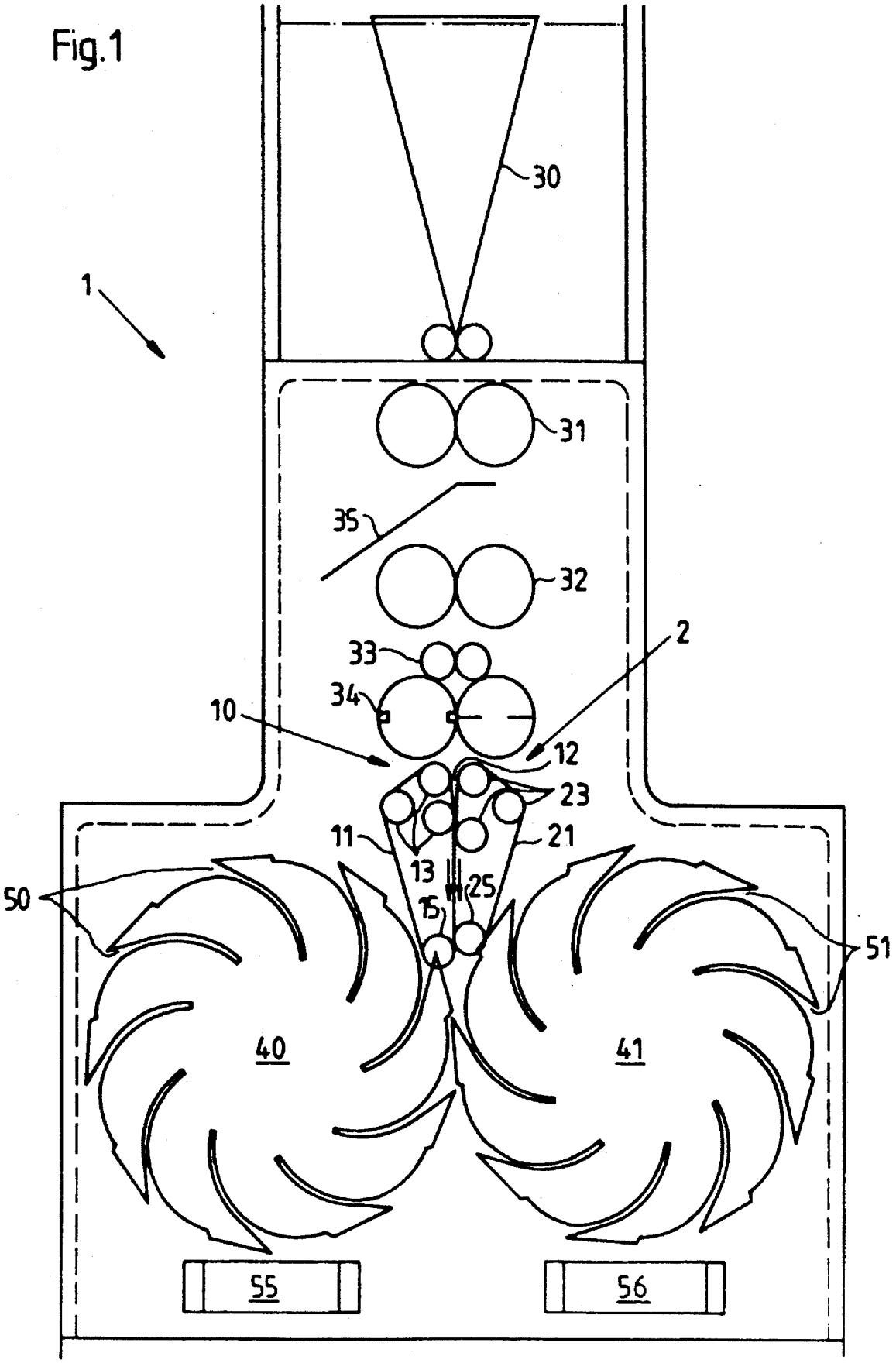
FIG. 1 shows a side-view of a typical folder apparatus for web-fed printing press.

FIG. 1 shows a typical folder apparatus 1 for a web-fed printing press. The printed webs are conducted over a former 30 and folded. After being folded, the web is fed through the nips of tipper and lower draw rollers 31 and 32, respectively, and guide rollers 33 to a cutting cylinder 34, which severs the web to form printed signatures. A web separating device 35 is provided between the upper draw rollers 31 and the lower draw rollers 32.

The signatures are then fed by a lead-in tape system 2 to fan pockets 50 and 51 of fans 40 and 41, respectively. As the fans 40 and 41 rotate, the signatures are deposited to stacks 55 and 56, respectively. The lead-in tape system 2 has at least one lead-in-tape mechanism, and preferably more than one side-by-side and parallel lead-tape mechanisms with coaxial exit rollers, including a first lead-in tape mechanism 10, for grasping the signatures across its width.

The first lead-in tape mechanism 10 has a left lead-in tape 11 and a corresponding right lead-in tape 21, the lead-in tapes 11 and. 21 forming a signature passage for individual signatures, such as signatures 3 and 4 shown. A head-to-tail space or gap 5 exists between the signatures 3 and 4. The lead-in tape mechanism 10 also has left upper rollers 13 and right upper rollers 23, which can comprise guide or drive rollers for guiding and driving the left and right lead-in tapes 11 and 21, respectively. The lead in-tape mechanism 10 also has left exit roller 15 and corresponding fight exit roller 25.

Figure 2:
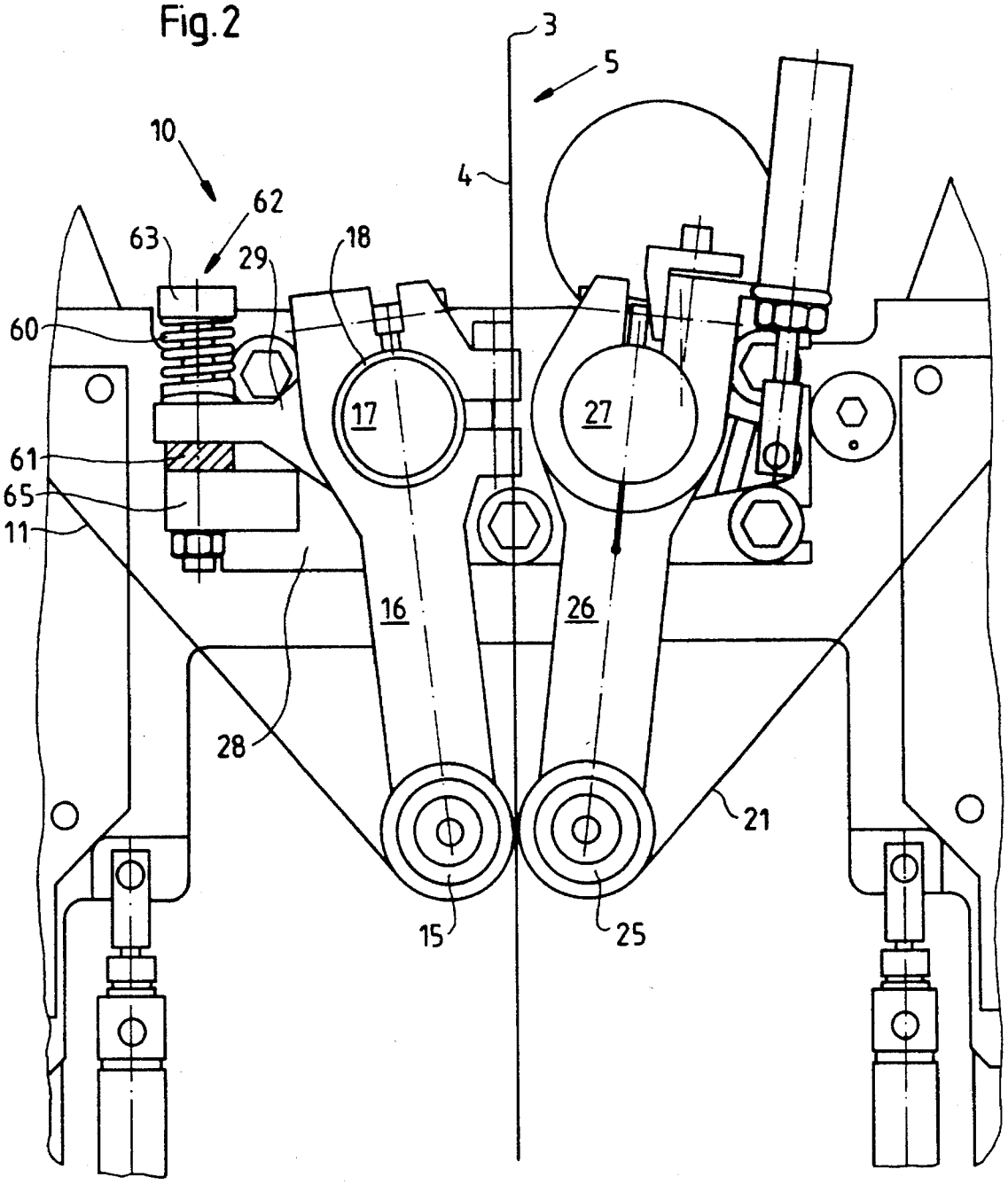
FIG. 2 shows a side view of a lead-in tape mechanism according to the present invention.

FIG. 2 shows the lead-in tape mechanism 10, one of preferably a plurality of side-by-side lead in tape mechanisms. The tape mechanism 10 has left lead-in tape 11 and corresponding right lead-in tape 21. The left exit roller 15 is mounted at one end on a left lever 16, which is fixedly mounted at the other end to a sleeve 18. Sleeve 18 can rotate around a stud 17, which is mounted to a frame component 28, to allow the left lever 16 and left exit roller 15 to be spring-loaded against the right exit roller 25, as will be described below. On the right side, right exit roller 25 is mounted on one end on a right lever 26, which is fixedly mounted at the other end to a fixed stud 27. Fixed stud 27 is fixedly mounted to the frame component 28, so that the right exit roller 25 can rotate but is translationally fixed during operation.

An arm 29 is also fixed by a clamp bolt to the sleeve 18, the arm 29 having a top side and a bottom side. A coil spring 60 is located around a preload bolt 62 having a bolt head 63, the coil spring 60 operating between the bolt head 63 and the top side of the arm 29. The bolt 62 is threadedly received in a mounting apparatus 65 fixed to the frame component 28, and also passes through a hole in the arm 29. The preload of the spring 60 can be changed by tightening or loosening the bolt 62. During this change, the clamp bolt of the arm 29 can be loosened to allow the arm 29 to rotate on the sleeve 18, and later be retightened. This can be done without effecting the position of the lever 16, which has its own clamp bolt.

Between the top of the mounting apparatus 65 and the bottom side of the arm 29, and around the bolt 62, is located a second spring 61, which may, for example, be made of an elastomeric material, and preferably has a high spring rate. Second spring 61 also preferably has additional dampening properties to reduce loading and vibration effects.

As illustrated in FIG. 4, for a high speed web printing press operating at speeds of up to 3000 ft/min, a preferable spring rate for the coil spring would be approximately 50–100 lbs/in and a preferable spring rate for the second spring would be approximately 500–1000 lbs/in, although the optimal spring rate may vary depending on web thickness, normal operating speeds, and other factors.

In operation, the individual signatures 3, 4 pass between the corresponding lead-in tapes 11, 21. The coil spring 60 forces the arm 29, and therefore lever 16 and left exit roller 15, through the sleeve 18, in the direction of the right exit roller 25. The second spring 61 opposes this motion. As the signature gap between two signatures passes the exit rollers 15, 25, the high spring rate spring 61 absorbs the high dynamic loads and reduces much of the pounding caused by the signature gaps.

Figure 3:
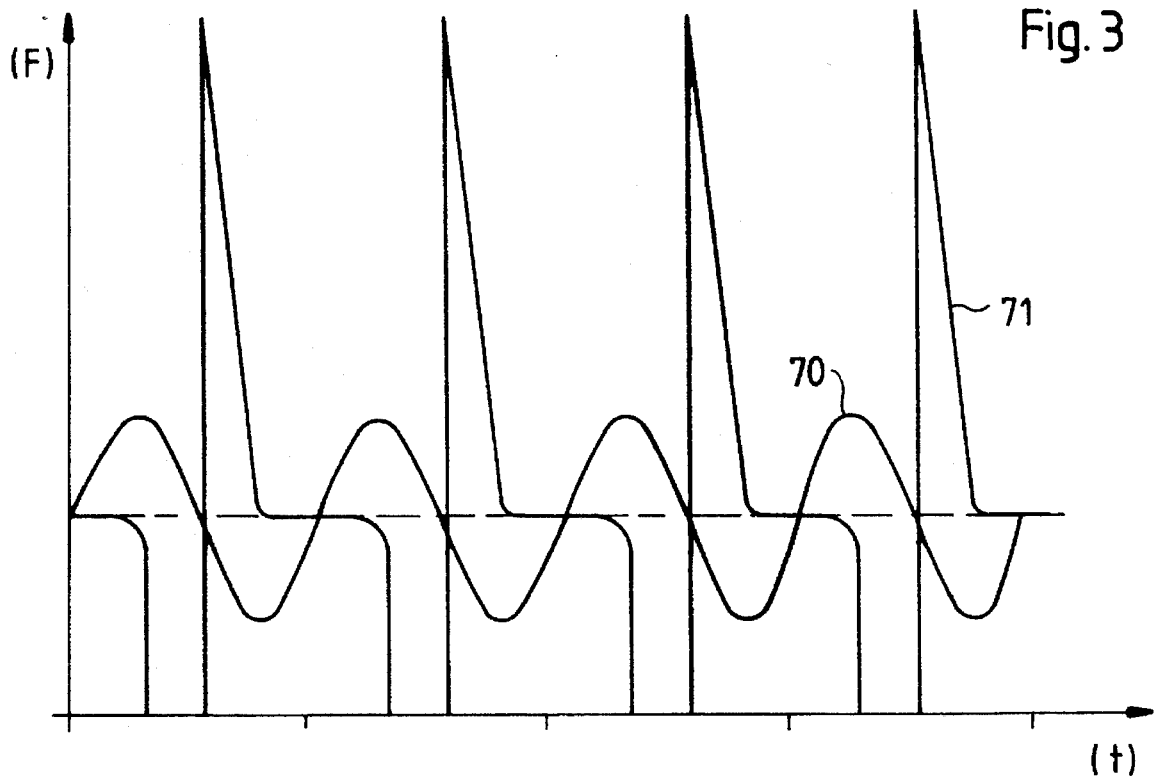
FIG. 3 is a graph showing the force-reducing effects of the present invention.

As shown in FIG. 3, the forces at the bolt head 63 are significantly reduced by the presence of the high spring rate spring. The line marked 70 shows the variation of the forces encountered during operation at the bolt head 63, while the line marked 71 shows the forces on a similar bolt head where only a coil spring acts between an arm and the bolt head. The time between the peaks is the time for a single signature to pass by the exit rollers.

While the present invention has been detailed in the embodiment described above, it is also contemplated the invention may encompass further embodiments than those described, and particularly that different types of springs may be used, rather than coil and elastomeric springs.

What is claimed is:

1. A folder apparatus comprising:

at least one lead-in tape mechanism having a first lead-in tape and first exit roller and a corresponding second lead-in tape and second exit roller, the first and second lead-in tapes forming a signature passage for delivery of a signature;

the first exit roller rotatable about a first roller axis but otherwise fixed; and a lever for supporting the second exit roller, the second exit roller rotatably mounted on the lever about a second roller axis;

an arm connected to the lever, the arm having a first side and an opposing second side;

a first spring acting against the first side of the arm to urge the lever and second exit roller in the direction of the first exit roller; and a second spring acting against the second side of the arm.

2. The folder apparatus as recited in claim 1 wherein the first and second springs have different spring rates.

3. The folder apparatus as recited in claim 1 wherein the first spring has a lower spring rate than the second spring.

4. The folder apparatus as recited in claim 1 wherein the first spring is a coil spring.

5. The folder apparatus as recited in claim 1 wherein the first spring has a spring rate of approximately 50–100 lbs/in.

6. The folder apparatus as recited in claim 1 wherein the second spring is made of an elastomeric material.

7. The folder apparatus as recited in claim 1 wherein the second spring has a spring rate of approximately 500–1000 lbs/in.

8. The folder apparatus as recited in claim 1 further comprising a stud, the arm being connected to the lever by the stud.

9. The folder apparatus as recited in claim 1 further comprising a bolt, the bolt having a bolt head and passing through the arm, the first spring and the second spring.

10. The folder apparatus as recited in claim 9 further comprising a mounting apparatus, the bolt threadedly mounted in the mounting apparatus.

11. The folder apparatus as recited in claim 1 wherein the second spring has dampening properties to reduce loading and vibration effects.

* * * * *

UNITED STATES PATENT AND TRADEMARK OFFICE

CERTIFICATE OF CORRECTION

PATENT NO. : 5,490,666

DATED : February 13, 1996

INVENTOR(S) : Kevin F. Albert

It is certified that error appears in the above-indentified patent and that said Letters Patent is hereby corrected as shown below:

On THE TITLE PAGE: Change item [73]: Assignees: Heidelberger Druchemaschiner AG," to --[73] Assignees: Heidelberger Druckmaschinen AG,--.

On THE ABSTRACT, line 4: Change "fight" to --right--.

| Column | Line | |
|---|---|---|
| 2 | 29 | Change "tipper" to --upper--. |

Signed and Sealed this

Fifth Day of November, 1996

*Attest:*

Bruce Lehman

BRUCE LEHMAN

*Attesting Officer*

*Commissioner of Patents and Trademarks*